US005525165A

United States Patent [19]

Wu et al.

[11] Patent Number: 5,525,165

[45] Date of Patent: Jun. 11, 1996

[54] METHOD OF SURFACE MODIFICATION OF TITANIUM ALLOY

[75] Inventors: Jiann-Kuo Wu; Fu-Der Lai, both of Taipei, Taiwan

[73] Assignee: National Science Council, Taiwan

[21] Appl. No.: 254,131

[22] Filed: Jun. 6, 1994

[51] Int. Cl.[6] ..... C23C 8/30

[52] U.S. Cl. ..... 148/219; 148/237; 148/28

[58] Field of Search ..... 148/218, 219, 148/234, 237, 238, 247, 28

[56] References Cited

U.S. PATENT DOCUMENTS

| | | | |
|---|---|---|---|
| 2,892,743 | 6/1959 | Griest et al. | 148/237 |
| 3,194,696 | 7/1965 | Müller | 148/28 |
| 3,268,372 | 8/1966 | Brotherton et al. | 148/237 |
| 5,102,476 | 4/1992 | Wahl | 148/218 |

FOREIGN PATENT DOCUMENTS

| | | | |
|---|---|---|---|
| 0840192 | 6/1981 | U.S.S.R. | 148/28 |

OTHER PUBLICATIONS

Steigerwald, "One Salt Bath for Both Carburizing and Cyaniding" Jul. 1947 Materials & Methods pp. 75–77 148/28.

*Primary Examiner*—Scott Kastler
*Attorney, Agent, or Firm*—Marshall & Melhorn

[57] ABSTRACT

A cyaniding process, operating in a molten cyanide salt, and a nitriding process, operating in a Tufftride salt bath, can be utilized to modify the near-surface microstructure of Ti-6Al-4V alloy. The surface-hardened layers have been characterized with respect to their hardness and microstructure. The corrosion and wear performance can be both improved by cyaniding and nitriding.

4 Claims, 3 Drawing Sheets

METHOD OF SURFACE MODIFICATION OF TITANIUM ALLOY

FIELD OF THE INVENTION

The present invention relates to a method of surface modification of titanium alloy, especially to a method of surface modification of titanium alloy using a salt bath to improve surface hardness.

BACKGROUND OF THE INVENTION

The ion implantation process for the surface modification of Ti-6Al-4V alloy involves the diffusion of nitrogen or carbon into the surface of titanium alloy. The improved wear characteristics and better corrosion resistance that result from this process are attributed to the precipitation of TiN or TiC, as disclosed in P. Sioshansi, J Met., 42(3) (1990) 30, A. Chen, K. Sridharan, J. R. Conrad and R. P. Fetherston, Surf. Coat. Technol., 50(1991)1, A. Mucha and M. Braun, Surf. Coat. Technol., 50(1992)135, F. M. Kustas, M. S. Misra, R. Wei, P. J. Wilbur and J. A. Knapp, Surf. Coat. Technol., 51(1992)100, and F. M. Kustas, M. S. Misra, R. Wei and P. J. Wilbur, Surf. Coat. Technol., 51(1992)106. However, a high equipment cost is inherent in the ion implantation process.

SUMMARY OF THE INVENTION

The object of the present invention is to provide a method to increase the surface of titanium alloy, so as to improve wear resistance and other mechanical properties of the titanium alloy.

The above objects are fulfilled by providing a method of modifying the surface of a titanium alloy. The method comprises the following steps of: (a) providing a salt containing 30 weight percent NaCN, 30 weight percent NaCl and 40 weight percent $BaCl_2$; and (b) heating the titanium alloy in said salt at about 860° C.

BRIEF DESCRIPTION OF THE DRAWING

The present invention will become more fully understood from the detailed description given hereinafter with reference to the accompanying drawings which are given by way of illustration only, and thus are not limitative of the present invention and wherein.

DETAILED DESCRIPTION OF THE PRESENT INVENTION

Figure 1A:
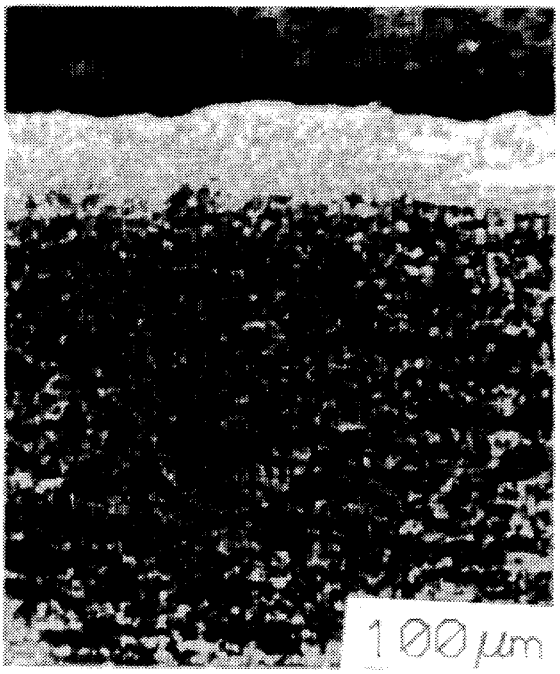
FIG. 1*a* shows the microstructure of a sample processed by cyaniding for 1.5 hr.
Figure 1B:
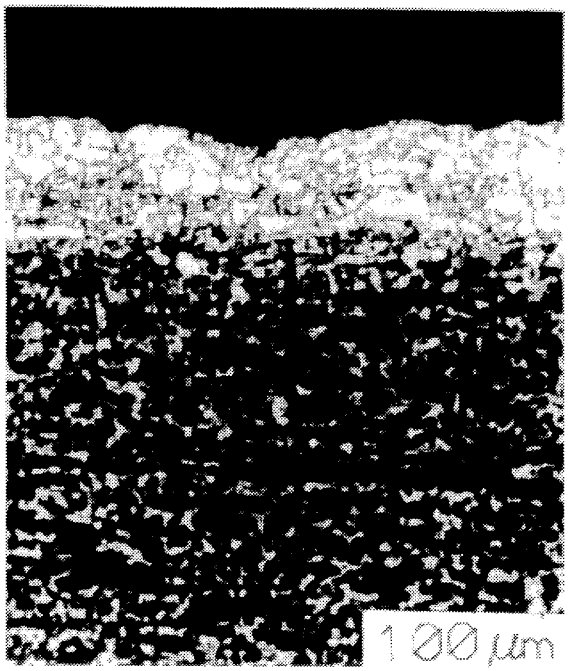
FIG. 1*b* shows the microstructure of a sample processed by cyaniding for 2.5 hr.
Figure 1C:
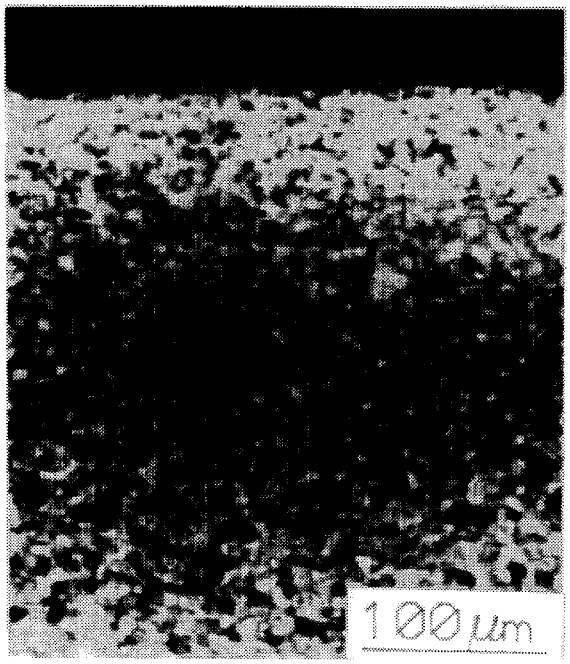
FIG. 1*c* shows the microstructure of a sample processed by cyaniding for 8 hr.
Figure 1D:
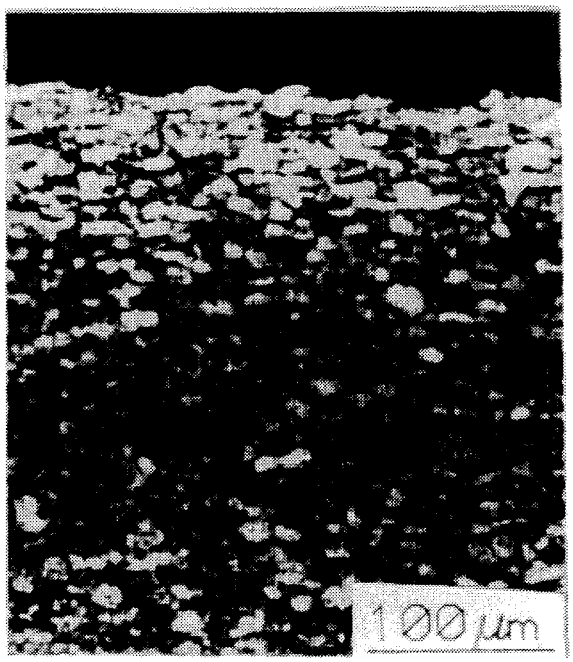
FIG. 1*d* shows the microstructure of a sample processed by nitriding for 2.5 hr.

Cyaniding and nitriding are attractive processes that produce a wear-resistant surface on steel parts. In the present invention, cyanide-type and nitride-type baths are used to modify the near-surface microstructure of Ti-6Al-4V alloy, which will be discussed in detail hereinafter by an experiment.

A mill-annealed Ti-6Al-4V alloy was used in this experiment. The composition of the alloy is listed in Table 1. All the specimens were cut into flat coupons (25 mm in diameter and 2 mm thick), then ground to a surface roughness of 0.121 μm Ra (Table 2). Both cyanide-type and nitride-type baths were used to modify the surface hardness of Ti-6Al-4V alloy. Three samples were processed by high temperature cyaniding for 1.5, 2.5 and 8 hr at 860° C., then the samples were quenched in oil. The bath contains 30 weight percent NaCN, 30 weight percent NaCl and 40 weight percent $BaCl_2$. One sample was processed by low temperature bath using a proprietary salt (Tufftride TF1, which is available on the market) and the treatments were performed for 2.5 hr at 580° C., with subsequent oil quenching. After the surface-hardening process was completed, the surface of the specimens was cleaned in 1M HCl solution, then washed ultrasonically with deionized water.

TABLE 1

| Chemical composition of the alloy tested (wt. %) | | | | | | | |
|---|---|---|---|---|---|---|---|
| Al | V | C | Fe | O | N | H | Ti |
| 6.32 | 4.14 | 0.04 | 0.14 | 0.16 | 0.01 | 0.04 | Balance |

TABLE 2

| Surface roughness of the ground specimen (μm) | | | |
|---|---|---|---|
| Ra | Rq | Rt | Rtm |
| 0.121 | 0.176 | 1.507 | 0.813 |

All the immersion experiments were conducted at 25°±1° C. in 1M NaCl, and 1M and 10M $H_2SO_4$ solutions under atmospheric conditions for four days. The specimens were removed, weighted and recorded, and the corrosion rates were calculated.

X-ray diffraction and optical microscopy were used to determine the structure and thickness of the hardened layer on the processed specimens. The surface roughness was measured using a Talyfurf 6 system (Rank Taylor-Habson Limited). The microhardness tests were carried out using a Matsuzawa MXT 50 automatic tester under a load of 10 g for 30 seconds.

FIGS. 1*a*–1*d* show the cross-section of the micro-structure after three different high temperature cyaniding times and one low temperature nitriding process. Both carbon and nitrogen addition stabilize the α phase (light) in titanium alloy.

Figure 2:
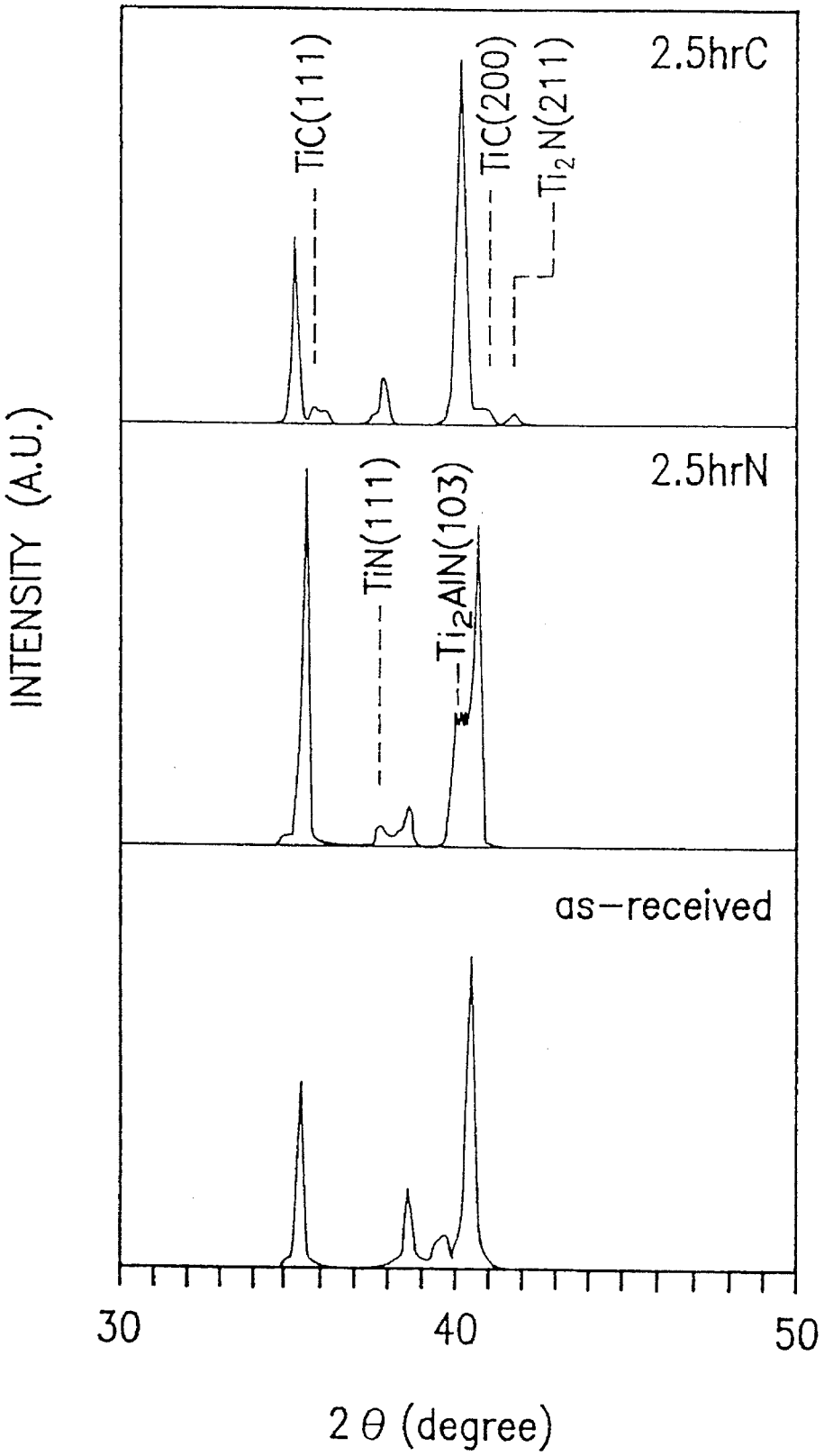
FIG. 2 shows the X-ray diffraction diagram of the sample processed by cyaniding for 2.5 hr, the sample processed by nitriding for 2.5 hr, and a sample not processed.

X-ray diffraction analysis for the surface-modified specimens is shown in FIG. 2. It was found that the surface-hardened layers are composed mainly of α-Ti with small amounts of TiC and $Ti_2N$ in the specimen subjected to high temperature cyaniding for 2.5 h (2.5 hr C.). In the specimen subjected to low temperature nitriding for 2.5 h (2.5 hr C.), the composition was mainly α-Ti with small amounts of TiN and $Ti_2AlN$.

Figure 3:
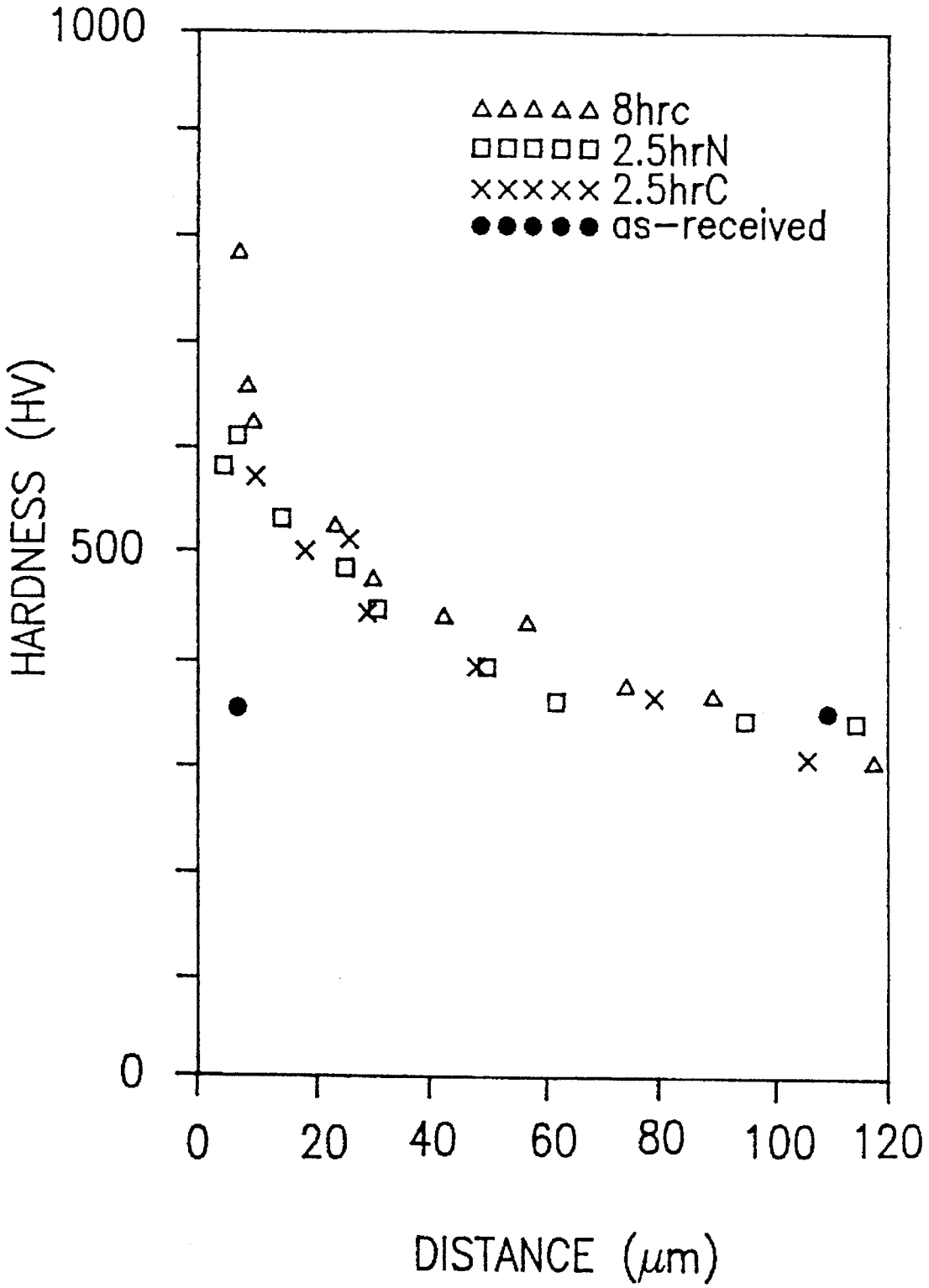
FIG. 3 shows the hardness to surface depth diagram of the samples processed by cyaniding for 8 hr and 2.5 hr, the sample processed by nitriding for 2.5 hr, and a sample not processed.

The hardness-depth profiles for three differently processed specimens are shown in FIG. 3. The specimens show improved hardness near the surface. The depth of the hardened surface layer depends on the processing bath composition, temperature and time. As expected, the high temperature cyaniding process provides superior hardening to that of the low temperature nitriding treatment. Cyanide case-hardening involves the diffusion of both carbon and nitrogen into the surface of the treated specimen. The source of the diffusing elements in this instance is the molten sodium cyanide salt.

The corrosion data are listed in Table 3. The cyanide surface-hardened layer, which contains mainly α-Ti phase and some $Ti_2N$ and TiC, is more corrosion resistant than either the nitrided or as-received specimens. This is probably because TiC and $Ti_2N$ are chemically inert and electrically insulating in the non-porous, continuous structure with a mainly α-Ti phase.

TABLE 3

| Corrosion rate from weight loss data | | |
|---|---|---|
| Specimen | Test solution | Corrosion rate (mdd)[1] |
| As received | 1M NaCl | Nil[2] |
| 2.5 hr[3] | | Nil |
| 2.5 hr[4] | | Nil |
| As received | 1M $H_2SO_4$ | 43 |
| 2.5 hrC | | 13 |
| 2.5 hrN | | 15 |
| As received | 10M $H_2SO_4$ | 1410 |
| 2.5 hrC | | 370 |
| 2.5 hrN | | 920 |

[1]mg $dm_{-2}(day)_{-2}$.
[2]Corrosion rate undetectable.
[3]2.5 hr cyaniding processed specimen.
[4]2.5 hr nitriding processed specimen.

Cyaniding (carbonitriding) and nitriding are both surface modification techniques that can improve the surface properties of Ti-6Al-4V alloy. The cyaniding process also provides excellent corrosion resistance and surface hardness. Performed in a Tufftriding salt bath at lower temperature, nitriding also provides effective improvements in the surface characteristics of this alloy.

While the invention has been described by way of examples and in terms of several preferred embodiments, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. A method of modifying the surface of a titanium alloy, comprising the following steps of:

(a) providing a salt containing 30 weight percent NaCN, 30 weight percent NaCl and 40 weight percent $BaCl_2$; and (b) heating the titanium alloy in said salt at about 860° C.

2. A method of modifying the surface of a titanium alloy as claimed in claim 1, wherein said step (b) is performed for at least 1.5 hours.

3. A method of modifying the surface of a titanium alloy as claimed in claim 1, wherein the titanium alloy is Ti-6Al-4V titanium alloy.

4. A method of modifying the surface of a titanium alloy as claimed in claim 1, further comprising:

(c) quenching the titanium alloy in oil.

* * * * *